US006172461B1

(12) United States Patent
Ha

(10) Patent No.: US 6,172,461 B1
(45) Date of Patent: Jan. 9, 2001

(54) TOP ELECTRODE IN COLOR PLASMA DISPLAY PANEL

(75) Inventor: Hong Ju Ha, Kyungsangbuk-do (KR)

(73) Assignee: LG Electronics Inc., Seoul (KR)

( * ) Notice: Under 35 U.S.C. 154(b), the term of this patent shall be extended for 0 days.

(21) Appl. No.: 09/104,233

(22) Filed: Jun. 25, 1998

(30) Foreign Application Priority Data

Jun. 27, 1997 (KR) ..... 97-28172

(51) Int. Cl.[7] ..... H01J 11/02
(52) U.S. Cl. ..... 313/585; 313/587
(58) Field of Search ..... 313/587, 586, 313/585, 583, 584, 581; 345/41, 60

(56) References Cited

U.S. PATENT DOCUMENTS 5,541,479 * 7/1996 Nagakubo ..... 313/584 X
5,736,815 * 4/1998 Amemiya ..... 313/584 X
5,825,128 * 10/1998 Betsui et al. ..... 313/584 X

* cited by examiner

*Primary Examiner*—Ashok Patel
(74) *Attorney, Agent, or Firm*—Fleshner & Kim, LLP

(57) ABSTRACT

Plasma display panel, is disclosed, having a top glass substrate, including sustain electrodes and scan electrodes formed on the top glass substrate arranged in parallel at fixed intervals, one pair of discharge electrodes formed in prescribed regions of the sustain electrodes and the scan electrodes projected in one direction respectively, for easy cell discharge, and a dielectric film and a protection film for protection of the sustain electrodes, the scan electrodes and the one pair of discharge electrodes, whereby allowing fabrication of a PDP with a high resolution.

21 Claims, 3 Drawing Sheets

TOP ELECTRODE IN COLOR PLASMA DISPLAY PANEL

BACKGROUND OF THE INVENTION

1. Field of the Invention

The present invention relates to a color plasma display panel(called "PDP"), and more particularly, to a top electrode in a color plasma display panel which has a large discharge region between a sustain electrode and a scan electrode.

2. Discussion of the Related Art

Being one of luminous devices for displaying an image using a gaseous discharge in a cell, the PDP, in general, is spot lighted as an image display device directed to a large sized, direct view type image display device, particularly to an HDTV (High Definition TeleVision) era because it has a very simple fabrication process, easy to fabricate a large sized device and has a fast response.

FIG. 1 illustrates a cross section of a unit cell of a background art PDP, wherein, for convenience of understanding, sustain electrodes 11 and 11' on the top glass substrate 10 are turned at 90° from a direction of an address electrode 15 on a bottom glass substrate 14.

Referring to FIG. 1, the background art PDP is provided with the top glass substrate 10 for displaying an image, the bottom glass substrate 14 spaced from, and disposed in parallel with the top glass substrate 10, a plurality of partition walls 16 disposed between the bottom glass substrate 14 and the top glass substrate 10 at fixed intervals, and a plurality of discharge spaces formed by jointing of the top glass substrate 10 and the bottom glass substrate 14. The PDP is provided with an address electrode 15 on the bottom glass substrate 14 between each of the plurality of partition walls 16, a fluorescent film 17 formed on both sides of the partition walls 16 and on the bottom glass substrate 14 to cover the address electrode 15 in an internal surface of each of the discharge spaces for emitting a visible light on discharge, and transparent electrodes 8 and 8' and bus electrodes 9 and 9' formed alternatingly at fixed intervals on the top glass substrate 10 at a surface facing the bottom glass substrate 14. The transparent electrodes 8 and 8' and the bus electrodes 9 and 9' are formed on a central part of the bottom glass substrate 14 perpendicular to the address electrode 15, dividing a screen of the PDP into a plurality of cells. And, there are a dielectric film 12 on the transparent electrodes 8 and 8' and the bus electrodes 9 and 9' for restricting a discharge current and a protective film 13 on the dielectric film 12 for protecting the transparent electrodes 8 and 8', the bus electrodes 9 and 9' and the dielectric film 12, and a mixture of inert gases, i.e., helium He as a major gas added with xenon Xe and neon Ne filled in each of the discharge spaces at 400~500 torr. The mixture gas induces penning effects when discharge in the cells.

A process of image display on the unit cell of the aforementioned background art PDP will be explained.

Upon application of a discharge voltage to the sustain electrodes 11 and 11' to cause a surface discharge, space charges generated in the cell accelerate micron electrons in the discharge gas to collide on neutral particles, which causes another collision, accelerating ionization of the neutral particles, converting the discharge gas into a plasma and emitting a vacuum ultraviolet ray. This vacuum ultraviolet ray excites the fluorescent film 17, to generates a visible light, which is shot outwardly through a display surface of the top glass surface 10. Thereafter, by keeping the application of the sustain voltage to the transparent electrodes 8 and 8' for a certain time period, a sustained discharge between the sustain electrodes 11 and 11' is caused, and by keeping each cell luminous for a certain time period, an image can be displayed.

FIG. 2 illustrates a plan view of a top electrode in a background art PDP.

Referring to FIG. 2, the PDP is provided with a plurality of partition walls 16 and one pair of transparent electrodes 8 and 8' and bus electrodes 9 and 9' formed at fixed intervals on a top glass substrate perpendicular to the partition walls 16. One pair of sustain electrodes 11 and 11' having the transparent electrodes 8 and 8' and the bus electrodes 9 and 9' include one pair of tooth formed projections 20-1 and 20-2 perpendicular to an address electrode(not shown) on a bottom glass substrate(not shown) and causes an entire screen divided into a plurality of cells. The pair of sustain electrodes 11 and 11' are formed of deposition of indium oxide $InO_2$ or tin oxide $SnO_2$, which are transparent. The tooth formed projections 20-1 and 20-2 are formed opposite to each other with a gap of 50 $\mu$m~80 $\mu$m.

The operation of the aforementioned background art PDP will be explained additionally referring to the elements that is omitted from FIG. 1.

Upon application of a sustain voltage to the sustain electrodes 11 and 11', wall charges are generated at ends of the pair of tooth formed projections 20-1 and 20-2, which cause a surface discharge within the discharge cell. The surface discharge causes another surface discharge in a discharge region 18 at surfaces of the dielectric film 12 and the protection film 13, that, in turn, generates a vacuum ultraviolet ray 19 which excites the fluorescent material in the fluorescent film 17, exhibiting a color.

However, since a structure of the top glass electrode in the background art PDP does not allow to secure a large discharge region between the sustain electrodes, implementation of a color PDP of a high luminance has been difficult.

SUMMARY OF THE INVENTION

Accordingly, the present invention is directed to a top electrode in a color plasma display panel that substantially obviates one or more of the problems due to limitations and disadvantages of the related art.

An object of the present invention is to provide a top electrode in a color plasma display panel which has a high luminance and efficiency.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the top electrode in a plasma display panel having a top glass substrate includes sustain electrodes and scan electrodes formed on the top glass substrate arranged in parallel at fixed intervals, one pair of discharge electrodes formed in prescribed regions of the sustain electrodes and the scan electrodes projected in one direction respectively, for easy cell discharge, and a dielectric film and a protection film for protection of the sustain electrodes, the scan electrodes and the one pair of discharge electrodes.

In other aspect of the present invention, there is provided a plasma display panel including a top panel including, sustain electrodes and scan electrodes formed on the top glass substrate arranged in parallel at fixed intervals, one pair of discharge electrodes formed in prescribed regions of the sustain electrodes and the scan electrodes projected in one direction respectively for easy cell discharge, and a dielectric film and a protection film for protection of the sustain electrodes, the scan electrodes and the one pair of discharge electrodes, and a bottom panel including address electrodes formed on a bottom glass substrate spaced a distance from, and parallel to the top panel, a plurality of partition walls arranged on a surface opposite to the top glass substrate at fixed intervals, and fluorescent films on the address electrodes and on the partition walls.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 3:
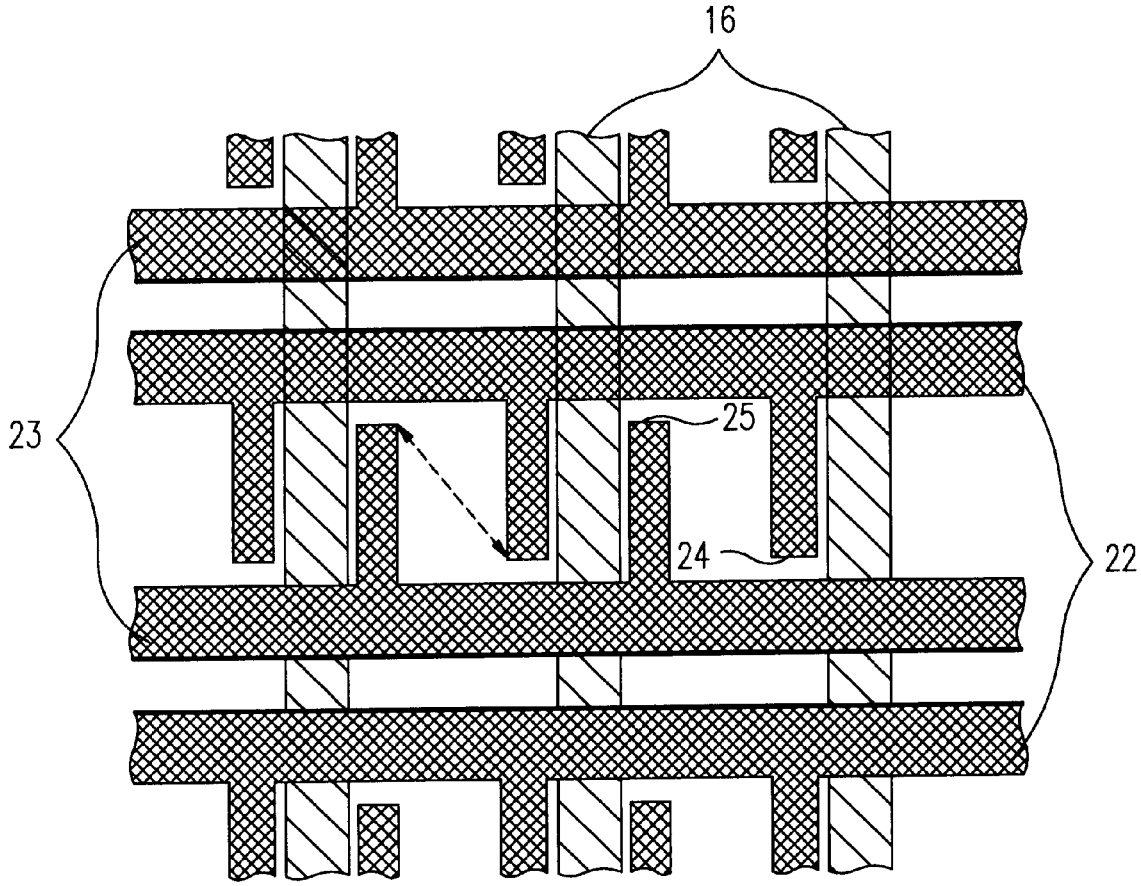
FIG. 3 illustrates a top electrode in a PDP in accordance with a preferred embodiment of the present invention; and, FIG. 4 illustrates a perspective view of a PDP in accordance with a preferred embodiment of the present invention.

Reference will now be made in detail to the preferred embodiments of the present invention, examples of which are illustrated in the accompanying drawings. FIG. 3 illustrates a top electrode in a PDP in accordance with a preferred embodiment of the present invention, and FIG. 4 illustrates a perspective view of a PDP in accordance with a preferred embodiment of the present invention.

Referring to FIG. 3, the top electrode in a PDP in accordance with a preferred embodiment of the present invention includes sustain electrodes 22 and scan electrodes 23 formed on a top glass substrate 10 arranged in parallel at fixed intervals. The sustain electrodes 22 and scan electrodes 23 are formed of metal. Each of the sustain electrodes 22 and the scan electrodes 23 respectively have a first discharge electrode 24 and a second electrode 25 along every partition wall which crosses the sustain electrodes 22 and the scan electrodes 23 in a vertical direction. the first discharge electrode 24 and the second electrode 25 are parallel to the partition walls 16. There is a gap in a range of 100 $\mu$m from an end of the first discharge electrode 24 to a side wall of the sustain electrode 22 and from an end of the second discharge electrode 25 to a side wall of the scan electrode 23, respectively. A gap between the first discharge electrode 24 and the second discharge electrode 25 is preferably in a range of 50 $\mu$m~300 $\mu$m. As shown in FIG. 3, the gap between the first discharge electrode 24 and the second discharge electrode 25 is greater than the gap between the sustain electrode 22 and the scan electrode 23. Therefore, if the gap between the first discharge electrode 24 and the second discharge electrode 25 is smaller than 50 $\mu$m, a discharge efficiency is dropped because a low voltage difference is occurred between the electrodes. And, if the gap between the first discharge electrode 24 and the second discharge electrode 25 is greater than 300 $\mu$m, the discharge efficiency is increased because a high voltage difference is occurred between the electrodes. If the gap between the first discharge electrode 24 and the second discharge electrode 25 is smaller than the gap between the first, and second discharge electrodes 24 and 25 and the partition walls 16, major discharge will be occurred restricted between the first, and second discharge electrodes 24 and 25 and the partition walls 16, reducing discharge as much. And, though the discharge between the first, and second discharge electrodes 24 and 25 and the partition walls 16 serves as a trigger, the discharge is unstable because the discharge space is too small to sustain a stable discharge. And, if the gas is charged at a higher pressure over 500 Torr, the discharge is unstable because a discharge voltage will rise significantly according to Pashen's law due to too small a gap between the electrodes. Therefore, it is necessary to cause a major discharge between sharp edges of the first discharge electrode 24 and the second discharge electrode 25.

Figure 4:
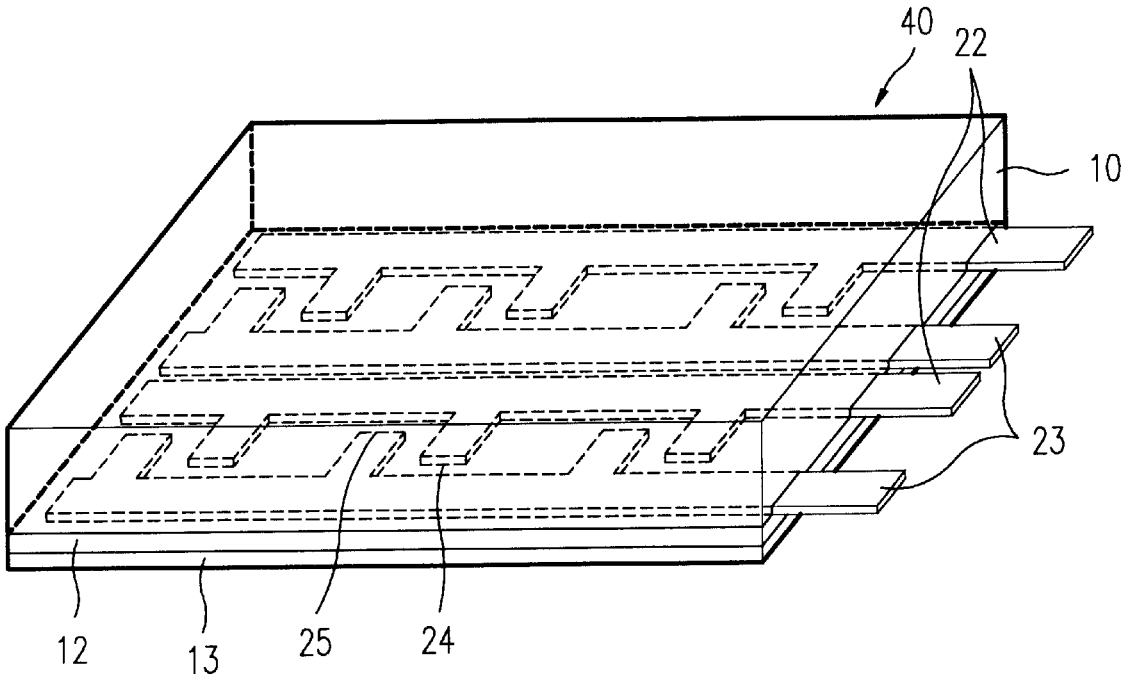
Figure 4:
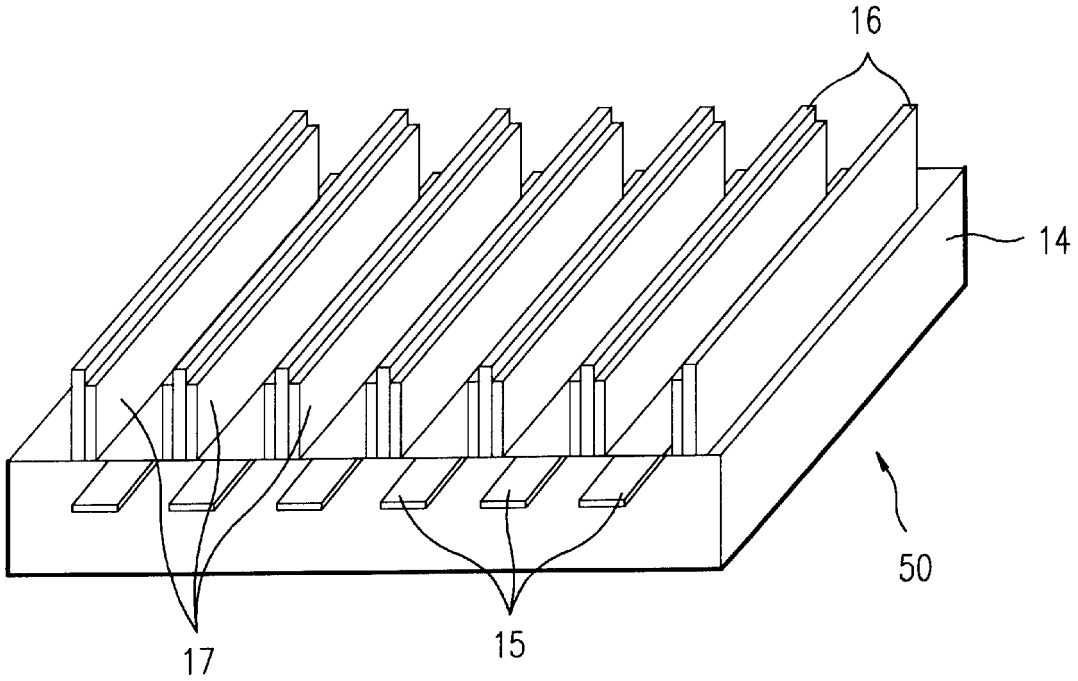

In the meantime, referring to FIG. 4, the top panel 40 of the present invention includes sustain electrodes 22 and scan electrodes 23 formed on a top glass substrate 10 arranged in parallel at fixed intervals, first, and second discharge electrodes 24 and 25 projected from prescribed regions of the sustain electrodes 22 and the scan electrodes 23 in one direction respectively for easy cell discharge, and a dielectric film 12 and a protection film 13 for protection of the sustain electrode 22, the scan electrode 23 and the first, and second discharge electrodes. And, there is a bottom panel 50 including address electrodes 15 on a bottom glass substrate 10 spaced a distance from, and arranged in parallel to the top panel 40, a plurality of partition walls 16 on a surface opposite to the top glass substrate 10 at fixed intervals, and R, G and B fluorescent films 17 formed on the address electrodes 15 and the partition walls 16.

The operation of the aforementioned top electrode in a PDP of the present invention will be explained with reference to FIGS. 3 and 4.

Figure 1:
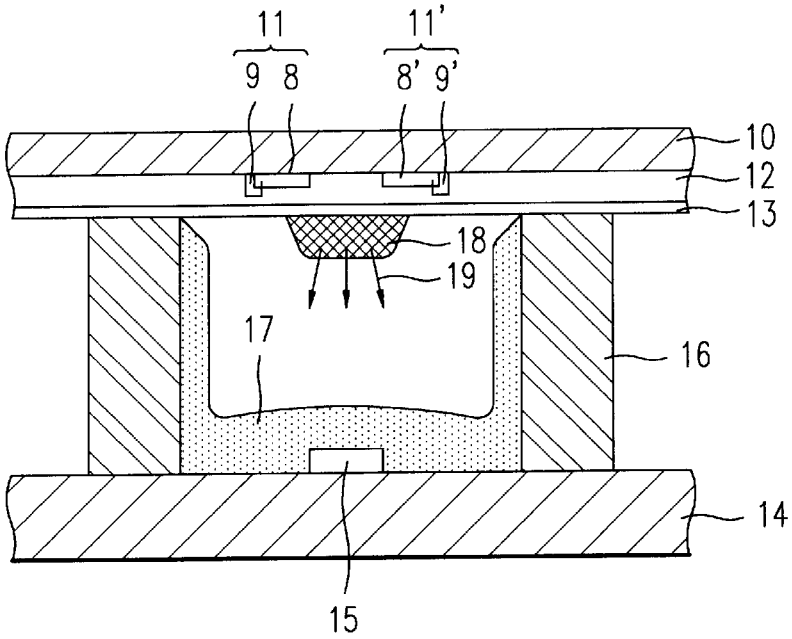
FIG.1 background art
FIG. 1 illustrates a cross section of a unit cell of a background art PDP.
Figure 2:
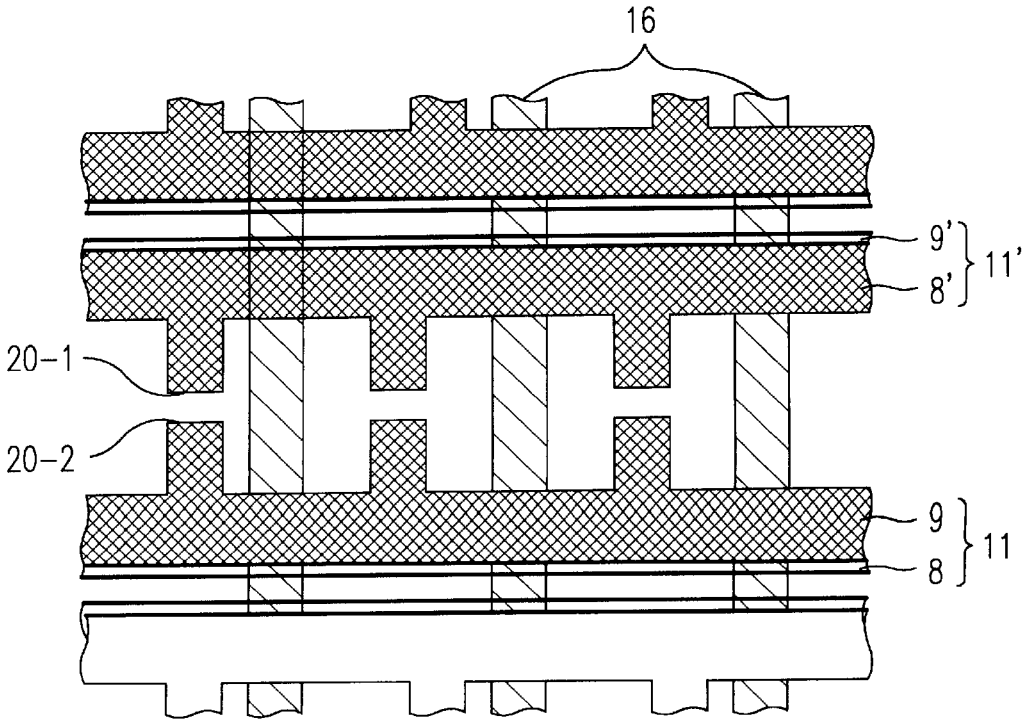
FIG.2 background art
FIG. 2 illustrates a plan view of a top electrode in a background art PDP.

Upon application of a driving voltage to the sustain electrode 22 and the scan electrode 23, wall charges are generated at sharp edges of the first discharge electrode 24 and the second discharge electrode 25. A voltage difference between the wall charges generated at the first discharge electrode 24 and the second discharge electrode 25 causes a write discharge and an erasure discharge between the electrodes. The write, and erasure discharges between the electrodes induce a sustained discharge in a discharge region 18 (see FIG. 1) at surfaces of the dielectric film 12 and the protection film 13, to generate a vacuum ultraviolet ray 19. The vacuum ultraviolet ray 19 excites the fluorescent film 17, to emit a visible light which is shot outwardly through the top glass substrate 10, displaying a color for a data fed through the address electrode 15. In other words, wall charges in a discharge cell are accelerated by a driving voltage applied thereto and make collision onto inert mixture gas[a penning mixture gas having helium He as a main component added with xenon Xe and neon Ne] filled in the discharge cell at a pressure in a range of 400~500 torr, to generate a vacuum ultraviolet ray 19 of 147 nm. The vacuum ultraviolet ray 19 excites the fluorescent film 17 during repetitive discharges of the discharge electrodes 22 and 23 proceeded in the steps of writing→erasing→sustaining and generates a visible light, to display a prescribed color.

As has been explained, since the top electrode in a color PDP of the present invention has one pair of discharge electrodes projected from a sustain electrode and a scan electrode which allows to secure a larger area of surface discharge area, the top electrode in a color PDP of the present invention allows fabrication of a PDP which has a high luminance, a high picture quality and a high reliability.

It will be apparent to those skilled in the art that various modifications and variations can be made in the top electrode in a color PDP of the present invention without departing from the spirit or scope of the invention. Thus, it is intended that the present invention cover the modifications and variations of this invention provided they come within the scope of the appended claims and their equivalents.

What is claimed is:

1. A top electrode in a plasma display panel, the plasma display panel having a top glass substrate, the top electrode comprising:

at least one pair of sustain and scan electrodes formed on the top glass substrate, the at least one pair of sustain and scan electrodes each extending in a first direction and arranged in parallel with a first fixed interval defined therebetween;

at least one pair of discharge electrodes, formed in predetermined regions of the at least one pair of sustain and scan electrodes and extending therefrom in a second direction, a first electrode of said at least one pair of discharge electrodes extending from said sustain electrode and a second electrode of said at least one pair of discharge electrodes extending from said scan electrode, wherein said first and second electrodes are separated by a second fixed interval in the first direction and overlap with each other in the second direction.

2. A top electrode as claimed in claim 1, wherein the at least one pair of sustain and scan electrodes is formed of metal.

3. A top electrode as claimed in claim 1, wherein the at least one pair of discharge electrodes is transparent.

4. A top electrode as claimed in claim 1, wherein the second fixed interval is within a range of about 50 $\mu$m~300 $\mu$m.

5. The top electrode as claimed in claim 1, wherein the second direction is perpendicular to the first direction.

6. The top electrode as claimed in claim 1, wherein the first electrode is separated from said scan electrode and the second electrode is separated from said scan electrode by a third fixed interval.

7. The top electrode as claimed in claim 6, wherein the third fixed interval is less than 100 $\mu$m.

8. The top electrode of claim 1, wherein the pair of discharge electrodes is formed within an area of a discharge space of the plasma display panel.

9. A plasma display panel comprising:

a top panel, including:

at least one pair of sustain and scan electrodes formed on a top glass substrate of the plasma display panel, the at least one pair of sustain and scan electrodes each extending in a first direction and arranged in parallel with a first fixed interval defined therebetween; and at least one pair of discharge electrodes formed in predetermined regions of the at least one pair of sustain and scan electrodes and extending therefrom in a second direction, a first electrode of said at least one pair of discharge electrodes extending from said sustain electrode and a second electrode of said at least one pair of discharge electrodes extending from said scan electrode, wherein said first and second electrodes are separated by a second fixed interval in the first direction and overlap with each other in the second direction; and a bottom panel, including:

address electrodes formed on a bottom glass substrate of the plasma display panel and spaced a distance from, and parallel to the top panel;

a plurality of partition walls arranged on a surface opposite to the top glass substrate and spaced apart at fixed intervals; and fluorescent films on the address electrodes and on the partition walls.

10. A plasma display panel as claimed in claim 9, wherein at least one pair of sustain and scan electrodes is formed of metal.

11. A plasma display panel as claimed in claim 9, wherein the at least one pair of discharge electrodes is transparent.

12. A plasma display panel as claimed in claim 9, wherein the second fixed interval is within a range of 50 $\mu$m~300 $\mu$m.

13. The plasma display panel as claimed in claim 9, wherein the second direction is perpendicular to the first direction.

14. The plasma display panel as claimed in claim 9, wherein the first electrode is separated from said scan electrode and the second electrode is separated from said scan electrode by a third fixed interval.

15. The plasma display panel as claimed in claim 9, wherein the third fixed interval is less than 100 $\mu$m.

16. The plasma display panel of claim 9, wherein the pair of discharge electrodes is formed within an area of a discharge space of the plasma display panel.

17. A top electrode in a plasma display panel, the plasma display panel having a top glass substrate, the top electrode comprising:

at least one pair of sustain and scan electrodes formed on the top glass substrate, the at least one pair of sustain and scan electrodes each extending in a first direction and arranged in parallel with a first fixed interval defined therebetween;

at least one pair of discharge electrodes formed in predetermined regions of the at least one pair of sustain and scan electrodes and extending therefrom in a second direction, a first electrode of said at least one pair of discharge electrodes extending from said sustain electrode and a second electrode of said at least one pair of discharge electrodes extending from said scan electrode, wherein said first and second electrodes are separated by a second fixed interval in the first direction.

18. The top electrode of claim 17, wherein the pair of discharge electrodes is formed within an area of a discharge space of the plasma display panel.

19. A plasma display panel comprising:

at least one pair of sustain and scan electrodes formed on a top glass substrate of the plasma display panel, the at least one pair of sustain and scan electrodes each extending in a first direction and arranged in parallel with a first fixed interval defined therebetween;

at least one pair of partitions separated by a second fixed interval and extending in a second direction;

at least one pair of discharge electrodes formed in predetermined regions of the at least one pair of sustain and scan electrodes and extending therefrom in the second direction, a first electrode of said at least one pair of discharge electrodes extending from said sustain electrode and a second electrode of said at least one pair of discharge electrodes extending from said scan electrode, wherein said first and second electrodes are not disposed within a plane which is positioned at a center point of said second fixed interval and extends in the second direction.

20. The plasma display panel of claim 19, wherein the first electrode is closer to a first wall of the pair of partitions and the second electrode is closer to a second wall of the pair of partitions.

21. The plasma display panel of claim 19 further comprising:

address electrodes formed on a bottom glass substrate of the plasma display panel and spaced a distance from, and parallel to the top panel, wherein the at least one pair partitions are arranged on a surface opposite to the top glass substrate and spaced apart at fixed intervals; and fluorescent films on the address electrodes and on the partition walls.

* * * * *